United States Patent [19]

Hagen et al.

[11] 3,937,531

[45] Feb. 10, 1976

[54] TELESCOPING DRAWER SLIDE SECTION FOR 2-MEMBER TELESCOPIC BALL BEARING SLIDES AFFORDING FULL EXTENSION

[76] Inventors: Magnus F. Hagen, 3713 Twilight Drive, Fullerton, Calif. 92632; Fred A. Jordan, 14906 Lodosa, Whittier, Calif. 90605

[22] Filed: Mar. 3, 1975

[21] Appl. No.: 554,536

[52] U.S. Cl. ..... 308/3.8; 312/348

[51] Int. Cl.[2] ..... F16C 21/00

[58] Field of Search..... 308/3.6, 3.8; 312/341 R, 312/343, 344, 346, 347, 348, 333, 349

[56] References Cited

UNITED STATES PATENTS 3,801,166 4/1974 York ..... 308/3.8

3,857,618 12/1974 Hagen et al..... 308/3.8

*Primary Examiner*—M. H. Wood, Jr.
*Assistant Examiner*—Gene A. Church
*Attorney, Agent, or Firm*—J. Carroll Baisch

[57] ABSTRACT

A telescoping drawer slide section for 2-member slides or mechanism to afford full extension. The slide section is of extruded plastic or other suitable material. There is a flange extending longitudinally along one edge of the slide section, said flange having openings therein for screws or the like for fastening the slide section to the side of a drawer, it being understood that there is a slide mechanism for each side of the drawer.

31 Claims, 11 Drawing Figures

TELESCOPING DRAWER SLIDE SECTION FOR 2-MEMBER TELESCOPIC BALL BEARING SLIDES AFFORDING FULL EXTENSION

BACKGROUND OF THE INVENTION

1. Field of the Invention

This invention relates generally to telescoping ball bearing drawer slides and relates more particularly to a drawer slide section for 2-member slides to permit full extension.

2. Description of the Prior Art

To achieve full extension of a drawer, if one assumes that the drawer depth is the same depth as the cabinet depth and that therefore the slide length is practically the length as the drawer depth, one requires a minimum of three telescoping slide sections to achieve full extension of the drawer, which means that the rear point of the drawer which is in line with the furthest rear point of the slide would need to be slightly to the front of the slide length or stationary slide section length as fully extended.

Therefore, a 2-member slide under the above circumstances could only extend the drawer somewhere 3/4 maximum because the last quarter of the sliding section needs to be contained within the stationary slide section and thus that portion of the drawer depth would not be fully extended.

A 3-section slide mechanism is substantially more expensive to manufacture than a 2-member slide. Also, there is a problem in providing means for removing a drawer from the slide mechanisms and replacing same.

SUMMARY OF THE INVENTION

A telescoping slide mechanism providing full extension and including inner and outer slide members and a slide section slidable on the outer slide member. The slide members comprise what is termed a 2-member slide and the slide section is extruded of plastic or other suitable material said slide section being attached to the side of a drawer of a desk, cabinet or the like, there being a slide mechanism for each side of the drawer.

The 2-member slide mechanism has an outer slide member and an inner slide member. The outer slide member has a longitudinally extending center wall along each side of which there is an outwardly and laterally extending ball race that is concavo-convex in cross-section with the concave surfaces facing inwardly so that said surfaces are oppositely arranged relative to each other and are spaced about laterally relative to the length of the center wall. At the inner end of the outer slide member, there is a flange tilted laterally at an angle substantially normal to the plane of the bottom wall and in a normal direction to the ball races. The flange is not long as the width of the bottom wall to leave clearance space at each end for the ball races of the inner slide member. At its other end, the outer slide member has a similar flange which serves as a stop. Thus, the flanges provide stop means at the respective ends of the outer slide member. Adjacent the outer end, the outer slide member has oppositely arranged notches in the ball races and the bottom wall is provided with reinforcing and strenghtening ridges. Spaced from the inner end of the outer slide member are stops on the ball races of said outer slide member. The inner slide member also has a bottom wall and along the longitudinally extending sides are side edges or laterally turned arcuately shaped ball races arranged with the concave surfaces facing laterally outwardly for operable release with the ball races of the outer slide member. The inner end of the inner slide member is open and intermediate the ends of the inner slide member is a stop of sound muffling material which engages the first mentioned stop of the outer slide member to limit extension of the slide members relative to each other.

The mounting means for the slide also includes a resilient butterfly type of mounting. One of the mounting means for mounting the slide mechanism to the drawer comprises a butterfly type of mounting which is attached to the inner slide member and which has a free part which extends laterally beyond the outer slide member. This butterfly mounting is resilient and is spaced from the adjacent surface outwardly of the inner slide member a sufficient distance to clear the adjacent edge portions of the plastic slide section. These edge portions curve over the ball races of the outer slide member and slidingly engage same to thereby slidably retain the slide section on the outer slide member. There are also bumper stop means of resilient sound absorbing and material carried by the ball retainer which engage stops on the slide muffling members to limit sliding movement of the slide members. This sound deadening stop not only muffles sound and functions as a stop for the slide members in the extended position, but, also absorbs shock when it engages stop means on the slide members. There are ball bearings in the ball races of the slide members and disposed between said slide members is a ball retainer.

The slide section comprises a longitudinally extending wall with arcuate longitudinally extending edge portions which curve about the respective ball races of the outer slide member for retaining the slide section thereon but which permit longitudinal sliding movement of the slide section on the outer slide member. An upstanding longitudinally extending flange runs adjacent the upper edge of the slide section and has openings for screws or the like for attaching the slide section to the sides of a drawer. Intermediate the ends of the slide section, there is an opening in the upper curved edge portion and adjacent the opening, there is a latch comprising a lever pivoted to the longitudinally extending flange with one end of the lever heavier than the other. This end of the lever has a block of suitable sound muffling material and said block is adapted to enter the opening in the upper arcuate part and into the upper notch of the ball race of the outer slide member. Because the end of the lever carrying the block is heavier than the other end, the block moves through the opening in the adjacent arcuate part and when the slide section is moved outwardly to a point whereat said opening aligns with the upper notch of the outer slide member, the block drops into said notch and prevents further outward sliding movement of the slide section. The latch may be raised to remove the block from said notch to permit the slide section to be moved outwardly and, if desired, removed from the outer slide member. The slide section may be replaced on the outer slide member and as it is moved inwardly, the block will drop into the notch but is so contoured that it will be raised out of the notch when the inner end of said notch is reached, thus permitting full telescoping of the slide section on the outer member. However, telescoping of the slide section on the outer slide member is limited by engagement of the inner end of the slide section with the stop on the upper ball race of the outer slide member.

Support of the drawer against sagging is insured by having a larger number of balls support the outer member in the extended position than in prior slides. However, as only part of the ball retainer and balls are engaged with the inner slide members in the extended position, the remaining balls remain exposed in the outer member. These latter balls come into action when the slide is telescoped so that all the balls in the slide will be engaged or functioning to give even more support to the outer member and prevent sagging of the front end of the drawer.

OBJECTS AND ADVANTAGES OF THE INVENTION

It is, therefore, an object of the present invention to provide a slide section of plastic or other suitable material for sliding attachment to a 2-member slide to afford full extension of the slide and the drawer.

Another object of the invention is to provide a latch for the slide section which only engages at the point where the extension, as chosen for the drawer, is reached.

A further object of the invention is to provide a latch of this character that may be readily released manually to permit the slide section to be pulled from the slide mechanism.

A still further object of the invention is to provide a slide section that may be easily slipped onto the outer slide member of the 2-member slide mechanism.

Another object of the invention is to provide a latch for the slide section which will operate automatically to permit the slide section to be fully slid onto the outer slide member but which will automatically latch when the slide section is pulled outwardly to a pre-selected extension point.

Still another object of the invention is to provide stiffening or reinforcing means for that part of the outer slide member having a notch or notches for the latch.

A further object of the invention is to provide for stiffening rib means on the inner side of the slide section for proper breathing of the straddling slide section around the intermediate slide member.

A further object of the invention is to provide a ball retainer which is partially exposed and where the stationary slide member will pass through the ball bearings at full extension.

A still further object of the invention is to provide a mechanism of the present character having a large number of balls supporting the outer member in the extended position of the slide and with previous ball retainers. As only part of the ball retainer and balls are engaged with the inner member in the extended position, the remaining are exposed in the outer member and come into action when the slide is telescoped.

A further object of the invention is to provide an arrangement of this character whereby when the slide members are telescoped, all the balls will be engaged giving more support to the outer member and so preventing sag of the front panel of the drawer.

A still further object of the invention is to provide a resilient sound deadening bumper of rubber or other suitable material which is mounted on the ball retainer and functions as a stop in the extended position.

Another object of the invention is to provide a resilient stop attached to the ball retainer in an exact relationship so that a stationary member will hit one end of the rubber stop and the moving slide member will hit the other end of the stop and thus provide a sound muffling engagement with no metal to metal contact and where no direct load or shock is carried by the metal ball retainer.

Still another object of the invention is to provide a rubber stop or other resilient material that is mounted on the ball retainer and absorbs shock, that is, a no load or shock stop is carried at all times by the ball retainer and is mounted thereon for absorbing such shocks.

Still another object of the invention is to provide breathing brackets arranged to provide clearance between the mounting surface of the stationary section and the straddling curvature of the drawer mounted plastic section which have to transverse along the length of the stationary section.

The characteristics and advantages of the invention are further sufficiently referred to in connection with the following detailed description of the accompanying drawings, which represent one embodiment. After considering this example, skilled persons will understand that many variations may be made without departing from the principles disclosed and I contemplate the employment of any structures, arrangements or modes of operation that are properly within the scope of the appended claims.

BRIEF DESCRIPTION OF THE DRAWING

Referring to the drawings which are for illustrative purposes only.

DESCRIPTION OF THE PREFERRED EMBODIMENT

Figures 1, 2, 3, 4, 5, 6, 7, 8, 9:
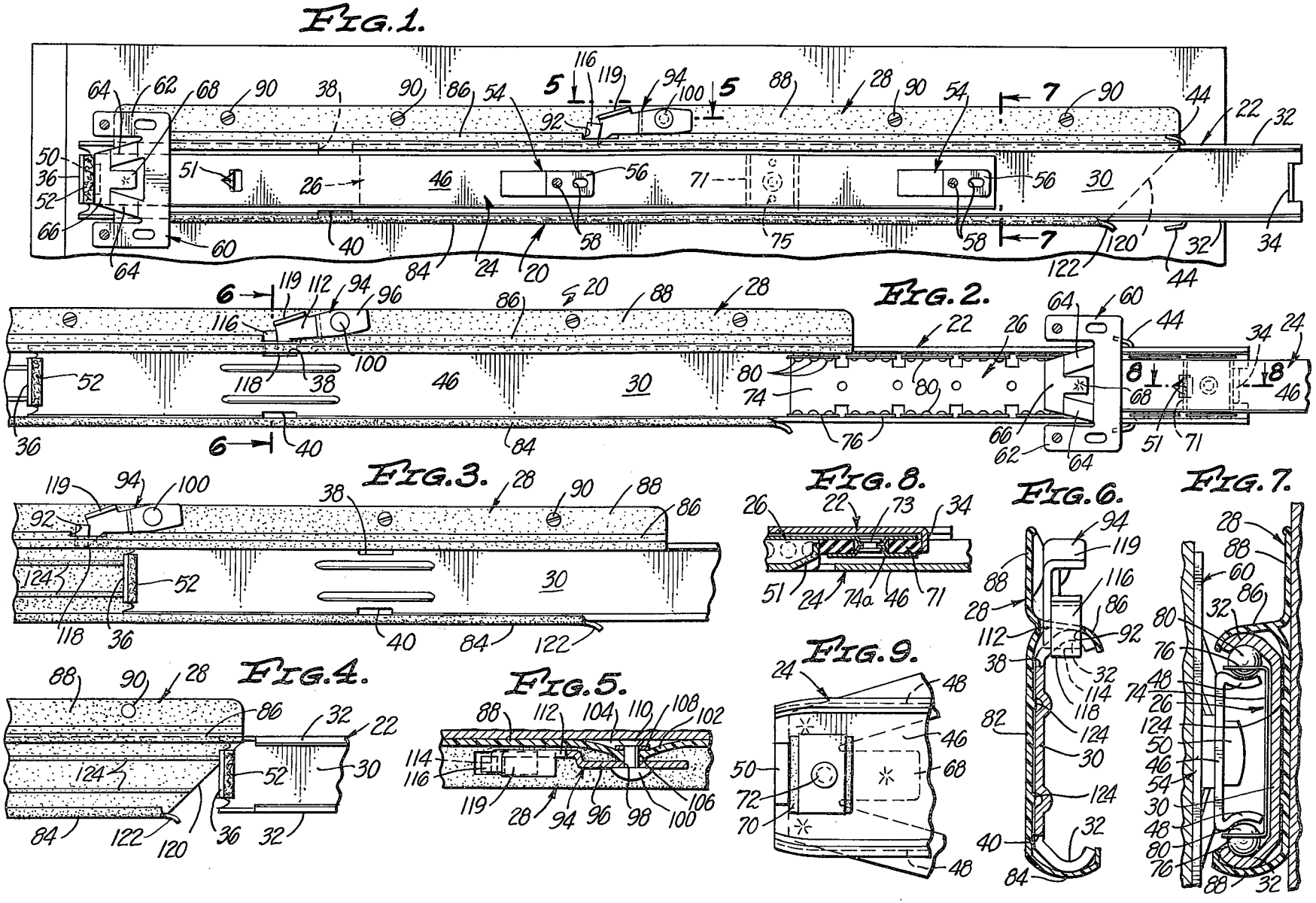
FIG. 1 is a side elevational view of the side mechanism which includes the slide members of the ball bearing telescoping slide mechanism which includes outer and inner slide members, ball retainer and slide section for a 2-member slide, the slide mechanism being in the telescope position.
FIG. 2 is a partial side elevational view thereof with the slide members and ball retainer in an extended position.
FIG. 3 is a similar view of a portion of the mechanism.
FIG. 4 is an enlarged fragmentary view showing the lead in for the slide section.
FIG. 5 is an enlarged sectional view taken on line 5—5 of FIG. 1.
FIG. 6 is an enlarged sectional view taken on line 6—6 of FIG. 2.
FIG. 7 is an enlarged sectional view taken on line 7—7 of FIG. 1.
FIG. 8 is an enlarged sectional view taken on line 8—8 of FIG. 2.
FIG. 9 is an enlarged fragmentary top plane view of one end of the inner slide member.

Referring to the drawings, there is shown a slide mechanism, indicated generally at 20, embodying the present invention. It is to be understood, of course, that there are two slide mechanisms for a desk or other drawer, one at each side of the drawer. Since the slide mechanisms are the same, a description of one such mechanism will be sufficient.

Each slide mechanism comprises a pair of slide members, an outer member indicated generally at 22, and an inner slide member, indicated generally at 24. There is a ball retainer operably disposed between the outer and inner slide members, said ball retainer being indicated generally at 26.

The slide mechanism further includes a slide section, indicated generally at 28. The slide section 28 is attached to the side of the drawer and one of the slide members is attached or secured to the adjacent side of that portion of the desk defining the drawer opening, there being sufficient clearance for the slide mechanism between the side of the drawer and the adjacent side or parts of the desk defining the drawer opening.

With the slide section secured to the side of the drawer, the inner slide member 24 is secured to the adjacent part or wall of the desk defining the drawer opening. Slide members 22 and 24 are generally channel chaped and formed of sheet metal by stamping, these parts being made with great accuracy. The slide section 28 is made of any suitable material such as plastic or the like although it may be made of metal. This slide section is extruded.

The outer slide member 22 has a longitudinally extending center wall 30 which may be termed the bottom of the channel. Along each side edge of the bottom 30, there is an outwardly and laterally extending ball race 32 that is concavo-convex in cross section with the concave surfaces facing inwardly so that said surfaces are oppositely arranged relative to each other and are spaced apart laterally relative to the length of the wall 30.

At one end of the outer member 22, there is a flange 34 that is turned laterally at an angle substantially normal to the plane of the bottom wall 30 and in a normal direction to the ball races 32. This flange is at the inner end of the outer slide member 22 so as to leave clearance space at each end of the flange for the ball races of the inner slide member when the device is assembled as described hereandafter but which serves as a stop.

At its other end, the outer member 22 is provided with a flange 36 that is turned laterally at a substantially normal angle to the plane of the bottom wall 30 and in a direction normal to the ball races 32. This flange serves as a stop. Thus, the flanges 34 and 36 provide stop means at the respective ends of the outer slide member.

Spaced longitudinally from the flange 36, the outer slide member has oppositely arranged notches 38 and 40 cut primarily from the respective ball races and the bottom wall 30 of the outer slide member is provided with ridges 42 pressed inwardly from the bottom wall 30 to provide reinforcing and strengthening means in the location or region of said notches 38 and 40. Spaced longitudinally from the flange 34, the outer slide member has hook or tongue-like stops 44 cut from the tops of the respective ball races of said outer slide member and extending outwardly therefrom.

An inner slide member 24 also has a bottom wall, indicated generally at 46, and along the longitudinally extending sides or side edges of which are laterally turned ball races 48 which are oppositely arranged and arcuate in cross section with the concave surfaces arranged oppositely respective adjacent ball races 32 of the outer slide member, said races 48 being spaced from said adjacent races 32.

One end of the inner slide member 24, has a flange 50 turned inwardly at an angle normal to the bottom wall 46. The opposite end of member 24 is open. The purpose of flange 50 is to engage flange 36 of the slide member to limit movement of the inner slide member toward the adjacent end of the outer slide member. It is to be noted that there is a pad 52 of sound muffling material secured to the inner side of the flange 36 to eliminate the noise of metal hitting metal, said pad being of any suitable material such as felt, rubber, or any suitable material.

The slide mechanism is provided with resilient mounting means for attachment to a part of a desk, cabinet or the like, said mounting means to accommodate to manufacturing tolerances and to insure proper alignment of the slide mechanism and drawer said mounting comprising a pair of ears 54 lanced from the bottom wall 46 of the inner slide member. Each ear has a free end part 56 which is spaced from the plane of the bottom wall 46 of the inner slide member and is provided with openings 58 for screws or the like whereby the slide mechanism is attached to said desk part or cabinet part. Because of the spacing of the free end parts 56 of the ears, which are resilient, the slide will accommodate itself to any variances which might occur because of manufacturing variations.

The mounting means for the slide also includes a resilient butterfly type of mounting indicated generally at 60.

This butterfly has a generally U-shaped part 62 with the arms thereof extending longitudinally outwardly. Between the arms, there are a pair of parts 64 spaced from the respective arms and inclined toward each other with the free ends of said parts connected together by a cross part 66. From the inner edge of said cross part, there is a tongue 68 which is spot welded or otherwise suitably secured to the bottom 46 of the inner slide member. Parts 64 are inclined away from the bottom 46 of the inner slide member so that the U-shaped part is spaced from the free edges of the adjacent ball races of the outer slide member.

At the inner side of the bottom 46 of the inner slide member and adjacent the flange 50, is a bumper 70 of sound muffling material which may be resilient, for example, the bumper may be of rubber, plastic or the like. There is a U-shaped metal cover **74*a* straddling the bumper 70 on the ball retainer and this cover and bumper are secured to the bottom wall 74 of the ball retainer by a rivet or eyelet 72 which extends through openings provided therefore in the cover, the bottom wall 74 of the ball retainer, and the bumper. There are two dimples 75 pressed inwardly from the bottom wall 74** of the ball retainer adjacent the rear end of the bumper to keep the bumper lined up longitudinally with the ball retainer axis.

Slide members 22 and 24 are arranged so that there open sides face each other and disposed between said members in the space between the parallel bottom walls 30 and 46 of the outer and inner slide members respectively, is the ball retainer 26. Ball retainer 26 comprises a longitudinally extending wall 74 and a plurality of longitudinally spaced flanges 76 normal to the longitudinally extending wall 74 and provided with openings therein for reception of ball bearing 80, said openings being smaller than the diameters of the ball bearings 80. These bearings are positioned at the outer sides of the flanges 76 and retain the balls in the ball races 32 and 48 of the outer and inner slide members. Respective flanges 76 may have one or more of the openings for the balls. Wall 74 is parallel to the walls 30 and 46 of the outer and inner slide members and is adapted to part spaced from the wall 30 of said outer slide member. When the slide members are telescoped, the flange 50 engages the padded flange 36 of the outer slide member and when the slide members are extended, the bumper 70 on the ball retainer engages the flanges 34 and 51 of the outer and inner slide members. When the slide members are thus extended, the inner end of the ball retainer extends beyond the adjacent end of the inner slide member so that part of the entire length of the ball retainer provides support for that part of the outer slide member projecting outwardly of a desk, cabinet or the like, leaving a section of the ball retainer exposed.

In the telescoped position of the slides, the entire length of the ball retainer provides support for the outer member. Thus, a relatively long ball retainer may be used and will hold the outer slide member and the drawer attached thereto against sagging.

The slide section 28 may be of any suitable material such as a stiff plastic and said section may be extruded. Section 28 comprises a longitudinally extending wall 82 with arcuate longitudinally extending edge portions 84 and 86 respectively which curve about the respective ball races of the outer slide member. These edge portions retain the slide section on the outer slide member but are slidable thereon so that the slide section 28 may be slid longitudinally on the outer slide member. Section 28 also includes an upstanding longitudinally extending flange 88 which runs adjacent the edge portion 86. This flange has a plurality of openings for reception of screws 90 whereby the slide section is secured to a desk, drawer or the like.

Intermediate the ends of the slide section, there is an opening 92 in the edge portion 86 and adjacent said openings, there is a latch, indicated generally at 94. Latch 94 comprises a body portion which has an opening 98 for a rivet 100 and about the opening 98, the flange is pressed toward the latch as indicated at 102 to provide a recess 104, there also being a boss 106 about the opening 98 to space the body 96 of the lever from the adjacent surface of the flange 88. On rivet 100, there is a washer 108 and the adjacent rivet end is overturned as at 110. In this arrangement, the overturned end of the rivet and the washer are received in the recess 104 so as not to project beyond the outer face of said flange 88. The body of latch 94 has an extension 112 that is off-set toward the adjacent side of the flange 88 and terminates in retaining flange 114 turned normal to the extension 112, a block 116 of sound muffling material is provided with a slot in which the retaining flange is disposed, said plug being of sound muffling material such as a suitable plastic or the like.

At the upper edge of the extension 112 of the latch, there is a longitudinally extending flange 119 normal to said extension and turned away from the flange 88 to provide means for raising the latch to move it to the unlatched position. Block 116 has a rounded or cam inner lower corner 118 so that when the slide section is moved inwardly onto the outer slide member, the latch will automatically move upwardly to permit the slide section to be moved to its inward position. The other edge of the block is adapted to engage the outer end of the notch 38 as shown in the drawings to limit outward movement of the slide section on the outer slide member, it being noted that the block drops through the opening 92 when the slide section is moved outwardly. Reverse movement of the slide member causes the latch to move upwardly of the release position when the slide section is moved inwardly on the outer slide member. It is to be noted that the portion of the longitudinally outwardly of the rivet is heavier than that portion at the opposite side of said rivet so that the latch lever will automatically move to the latching position when the slide section is moved outwardly.

The inner end of the slide section is inclined downwardly and outwardly, as at 120 so that when it is replaced on the outer slide member, the arcuate extending portion 86, is first rested on the upper ball race of the outer slide member and aids in supporting the drawer to which the slide member is attached when replacing the drawer on the slide mechanisms. Also, at the lower end of the arcuate, extending portion 84 has a downwardly turned end portion or lip 122 to insure easy and smooth replacing of the slide section.

On the inner side of the wall 82 of the slide section, are a pair of parallel slightly raised ridges 124 which slightly space the wall 82 from the adjacent side of the outer slide member and reduce friction. These ridges act as stiffining ribs and at the same time provide clearance for the proper elastic "breathing" of the straddling section around the outer slide member and they further accummulate some tolerances which is very important so that the part does not get stuck when moving.

Figure 10:
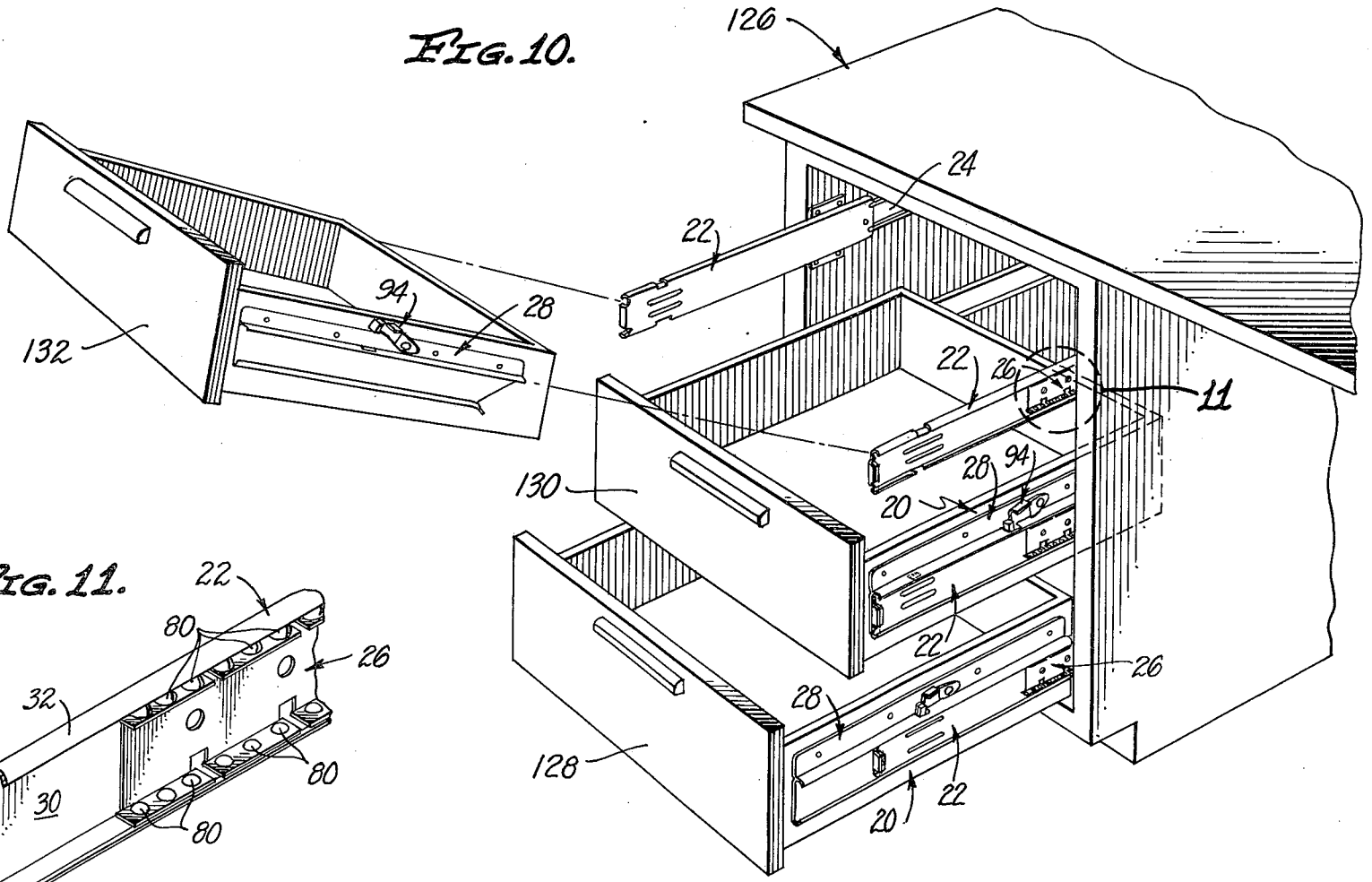
FIG. 10 is an enlarged perspective view of a cabinet with the present invention installed therein and showing 2 positions of the drawer slide mechanisms and also showing a drawer in the removed position.
Figure 11:
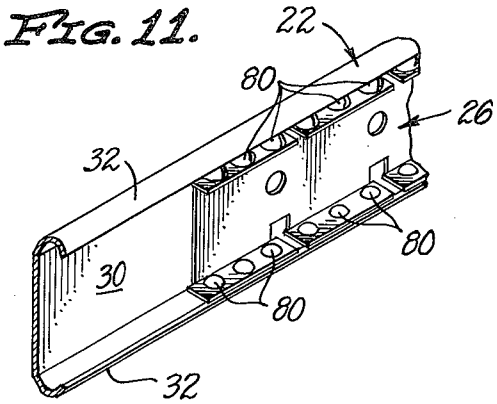
FIG. 11 is an enlarged view of the circled position of FIG. 10.

Referring to FIG. 10, there is shown a desk indicated generally at 126 having drawer openings for drawers indicated generally at 128, 130 and 132. Drawer 128 is shown as in the fully extended position and drawer 130 is shown with the slide in the 3/4 extended position. Drawer 132 is disconnected from the assembly of outer and inner slide members and ball retainers. It is to be noted that the inner slide members are secured to adjacent portions of the desk while the outer slide members are movable longitudinally thereof from a fully telescoped portion to a fully extended position. The slide mechanism for drawer 130 have been moved outwardly. The slide sections are in the telescope position relative to the outer slide members. When the drawer has been further pulled outwardly, as drawer 128, the slide sections are pulled outwardly relative to the outer slide members to a position whereat the latch block has dropped through the opening 92 of the slide section and into the notch 38 of the outer slide member thereby preventing the drawer from being pulled outwardly an additional amount. In order to remove the drawer from the outer slide members, the latches 94 are raised to the unlatched position by the operator's fingers lifting the flanges 119. The drawer and the slide sections 28 are then pulled outwardly a further distance so that the slide sections clear the outer slide members 22 of the slide mechanisms. The drawer is then freely removed from the outer slide sections. When it is desired to replace the drawer, the forward ends of the arcuate extending portions 86 of the slide sections are placed on the ball races of the outer slide members and the drawer pushed inwardly. Because of the rounded or cam shaped inner lower corner of the blocks of the latches, the slide section may be fully telescoped onto the outer slide member and the slide members telescoped as the drawer is moved further inwardly. It is to be understood, of course, that the drawer may then be moved entirely within the drawer opening to the normal closed position.

The invention and its attendant advantages will be understood from the foregoing description and it will be apparent that various changes may be made in the form, construction and arrangement of the parts without departing from the spirit or scope thereof or sacrificing it material advantages, the arrangement hereinbefore described being merely by way of example and I do not wish to be restricted to the specific form shown or uses mentioned except as defined in the accompanying claims.

We claim:

1. A telescoping ball bearing slide mechanism, comprising:

an outer slide member of generally channel-shape and having a longitudinally extending bottom wall and oppositely arranged ball races along the side edges of said bottom wall, said ball races being concave in cross section and facing each other;

an inner channel-shape slide member having a longitudinally extending bottom wall and oppositely facing ball races along the side edges thereof, said ball races being concave in cross section and facing outwardly the inner slide member being operably disposed within the outer slide member, said inner slide member being attachable to a part defining a drawer opening;

ball bearings disposed in adjacent races of the respective outer and inner slide members;

a ball retainer operably disposed between the outer and inner slide members for retaining the ball bearings operably in the races;

means for limiting extension of said slide members relative to each other;

means for limiting telescoping of said slide members relative to each other;

a slide section of generally U-shape in cross section comprising a longitudinally extending bottom wall and edge portions along the side edges of said bottom wall, said edge portions being arcuate in cross section and curved about the outer side of the ball races of the outer slide member, said slide section being slidable on the outer slide member;

and stop means for limiting telescoping movement of the slide section relative to the outer slide member.

2. The invention defined by claim 1, wherein the stop means for limiting telescoping movement of the slide section relative to the outer slide member comprises an ear on one of the ball races of the outer slide member.

3. The invention defined by claim 1, including resilient means on the inner slide member for mounting the slide mechanism to a part of a drawer opening, said resilient means including a resilient butterfly mounting having a transverse part extending beyond the arcuate edge portions of the slide section, said transverse part being spaced from said arcuate portions of said slide section to provide clearance therefor.

4. The invention defined by claim 1, including longitudinally extending ribs on the inner side of the bottom wall of the slide section.

5. The invention defined by claim 1, including means limiting extension of the slide section relative to the outer slide member.

6. The invention defined by claim 5, wherein said limiting means comprises a releasable latch.

7. The invention defined by claim 6, wherein the slide section has a longitudinally extending flange, there being an opening in the arcuate portion adjacent the flange in generally the same plane as the bottom wall of said slide section, and said latch comprises a latch lever pivoted to the flange of said slide section, said lever being pivoted closer to one end than the other end so that said other end is longer, a block attached to the longer end of said latch lever and adapted to extend through the opening in the adjacent arcuate edge portion of the slide section, there being a notch in the ball race of the outer slide member in line with the block and adapted to receive said block and prevent further extension of the slide section.

8. The invention defined by claim 7, includes at least one longitudinally extending rib in the bottom wall of the outer slide member and adjacent the notch in the ball race for reinforcing and strengthening wall of the bottom outer slide member.

9. The invention defined by claim 7, wherein the longitudinally extending flange of the slide section has a plurality of longitudinally spaced openings.

10. The invention defined by claim 8, wherein the block on said lever is of sound muffling material.

11. The invention defined by claim 6, wherein the latch means automatically operates to limit extension of the slide section and automatically permits telescoping of the slide section.

12. The invention defined by claim 11, wherein said block has a cam portion at the inner side engageable with the inner end of the notch in the ball race of the outer slide member for effecting the release of the latch when the slide section is moved inwardly on the outer slide member.

13. The invention defined by claim 7, wherein there is a second notch in the opposite ball race, said second notch being opposite the first mentioned notch.

14. The invention defined by claim 13, including stops on the ball races of the outer slide member adjacent the inner end thereof.

15. The invention defined by claim 13, wherein the bottom wall of the outer slide member has a plurality of ribs extending longitudinally adjacent the respective notches of the ball races of the outer slide member.

16. The invention defined by claim 7, wherein the latch lever is secured to the longitudinally extending flange of the slide section by rivet means extending through said flange, said flange having a recess at the inner side thereof for reception of the adjacent end of the rivet, the depth of said recess being at least as great as that portion of the rivet received therein.

17. The invention defined by claim 1, wherein the inner end of the slide section is inclined downwardly and outwardly whereby the inner end of the upper arcuate edge portion of the slide section, may be placed on the outer slide member when said inner end of the slide section is initially disposed on the outer slide member.

18. The invention defined by claim 17, wherein the inner end of the lower arcuate edge portion of the slide section has an inwardly and downwardly extending lip.

19. The invention defined by claim 13, including outwardly and upwardly inclined tongues lansed from the ball races of the outer slide member adjacent the inner end thereof to provide stop means for the slide section.

20. A telescoping ball bearing slide mechanism, comprising:

an outer slide member having a longitudinally extending bottom wall and oppositely arranged ball races along the side edges thereof;

an inner slide member having a longitudinally extending bottom wall and ball races along the side edges thereof for cooperation of the respective adjacent ball races of the outer slide member;

ball bearings disposed in adjacent races of the respective outer and inner slide members;

a ball retainer operably disposed between the outer and inner slide members for retaining the balls in said races;

a slide section having a longitudinally extending bottom wall and arcuate edge portions along the side edges thereof for slidable reception on the ball races of the outer slide member;

stop means limiting telescoping and extension of the slide members relative to each other;

means limiting telescoping movement of the slide section on the outer slide member;

and means limiting extension of said slide section on said outer slide member.

21. The invention defined by claim 20, wherein the means limiting extension of the slide section on the outer slide member is releasable to permit removal of the slide section from the outer slide member.

22. The invention defined by claim 1, wherein the inner end of the ball race is short of the inner end of the outer slide member when the slide members are fully extended.

23. A telescoping ball bearing slide mechanism comprising:

an outer slide member of generally channel-shape and a longitudinally extending bottom wall and oppostely arranged ball races along the side edges of the bottom wall, said ball races being concave in cross section and facing each other;

an inner channel-shape slide member having a longitudinally extending bottom wall and oppostely facing ball races along the side edges thereof, said ball races being concave in cross section and facing outwardly, the inner slide member being operably disposed within the outer slide member, said inner slide member being within the outer slide member and being attachable to a part defining a drawer opening;

ball bearings disposed in adjacent races of the respective outer and inner slide members;

a ball retainer operably disposed between the outer and inner slide members for retaining the balls operably in the races;

means for limiting extension of the slide members relative to each other;

means for limiting telescoping of said slide members relative to each other;

a slide section of generally U-shape in cross section comprising a longitudinally extending bottom wall, and edge portions along the side edges of said bottom wall, said edge portions being generally arcuate in cross section and curved about the outer sides of the ball races of the outer slide member, said slide section being slidable on the outer slide member;

an ear on the highest part of the upper ball race of the outer slide member for engagement by the inner end of the slide section to limit telescoping movement thereof;

a longitudinally extending flange upstanding along the top of the slide section, said flange having openings for reception of means for attaching the slide section to a drawer;

a latch lever pivotly mounted to the inner side of the flange of the slide section, and heavier at one end than at the other;

pivot means for pivotly mounting said latch lever, the outer end of said pivot means being recessed within the plane of the outer side of the flange of the slide section;

a block of sound muffling material attached to the heavier end of said lever, the adjacent arcuate edge portion of the slide section having an opening through which the block is adapted to extend;

the upper ball race of the outer slide member having a notch adjacent the outer end of the outer slide member and in line with the path of movement of the block and adapted to receive said block upon slidable movement of the slide section;

said block when in said notch, limits outward movement of the slide section but it is provided with a cam surface at the inner side whereby engagement with the inner end of the notch effects raising and unlatching of the latch, the operation of said latch automatically limiting outward movement of the slide section and automatically releasing said latch upon inward movement of the slide section;

the bottom wall of the outer slide member having at least one longitudinally extending reinforcing rib adjacent the notch in the ball race;

the inner end of the slide section being inclined downwardly and outwardly;

a downwardly and inwardly extending lip at the lower end of the lower slide section;

and resilient mounting means on the bottom wall of the inner slide member, said mounting means including a resilient butterfly part having a transverse portion spaced from the bottom wall of the slide member and from the arcuate side edge portions of the slide section when the latter is adjacent said butterfly part.

24. The invention defined by claim 23, wherein there are a pair of notches arranged oppositely each other in the respective ball races of the outer slide member, (making the slide) whereby the slide may be used on either side of the drawer.

25. The invention defined by claim 20 wherein stop means limiting extension of the slide members relative to each other comprises a resilient stop mounted on the ball retainer and absorbing shock.

26. The invention defined by claim 25, wherein the stop means limiting extension of the slide members relative to each other for providing a sound muffling engagement with no metal to metal contact and no direct load or shock carried by the metal of the ball retainer.

27. The invention defined by claim 26, wherein there is a metal U-shaped cover straddling the bumper on the ball retainer, said bumper and cover being secured to the ball retainer.

28. The invention defined by claim 27, wherein said U-shaped cover and bumper are secured to the ball retainer by eyelet through aligned openings provided therefore in said cover bumper and ball retainer.

29. The invention defined by claim 28, wherein there is means on the inner side of the ball retainer and adjacent to the bumper for keeping the bumper lined up longitudinally with the ball retainer axis.

30. The invention defined by claim 29, wherein said means for keeping the bumper lined up with the axis of the ball retainer comprises a pair of projections on the inner side of the ball retainer.

31. The invention defined by claim 20, wherein only part of the ball retainer and balls are engaged with the inner member in the extended position for supporting the outer member in the extended position of the slide and all of the balls function to support the outer slide member when the slide is telescoped so as to provide full support for the outer member and prevent sag of the front end of the drawer.

* * * * *